United States Patent [19]

Bielagus

[11] Patent Number: 4,953,795

[45] Date of Patent: Sep. 4, 1990

[54] WOOD CHIP CRACKING APPARATUS

[75] Inventor: Joseph Bielagus, Tualatin, Oreg.

[73] Assignee: Beloit Corporation, Beloit, Wis.

[21] Appl. No.: 261,455

[22] Filed: Oct. 24, 1988

[51] Int. Cl.[5] ..... B02C 4/30

[52] U.S. Cl. ..... 241/159; 100/176; 241/235; 241/236; 241/293

[58] Field of Search ..... 241/235, 236, 28, 159, 241/293, 224, 225, 226, 222; 100/176

[56] References Cited

U.S. PATENT DOCUMENTS

| | | | |
|---|---|---|---|
| 3,438 | 2/1844 | Battin | 241/235 |
| 1,980,193 | 11/1934 | Finegan . | |
| 3,387,795 | 6/1968 | Bidwell . | |
| 3,393,634 | 7/1968 | Blackford . | |
| 3,406,624 | 10/1968 | Kutchera et al. | 241/235 X |
| 4,050,980 | 9/1977 | Schmidt et al. . | |
| 4,235,382 | 11/1980 | Smith . | |
| 4,723,718 | 2/1988 | LaPointe | 241/235 |
| 4,903,845 | 2/1990 | Artiano . | |

FOREIGN PATENT DOCUMENTS

| | | | |
|---|---|---|---|
| 1174092 | 9/1911 | Canada . | |
| 0328067 | 8/1989 | European Pat. Off. . | |
| 2333727 | 2/1975 | Fed. Rep. of Germany . | |
| 2113572 | 6/1972 | France . | |
| 1037946 | 8/1983 | U.S.S.R. | 241/235 |
| 261753 | 12/1927 | United Kingdom | 241/235 |
| 406262 | 6/1932 | United Kingdom | 241/28 |

OTHER PUBLICATIONS

Lachenal, Monzi & deChoudens, "Chip Destructuring Improves Kraft Pulping", TAPPI Pulping Conf., Nov. 12–14, 1984, Book 1, pp. 13–17.

Oldham, "A Machine for Destructuring Wood Chips by Rolling", Appita, vol. 1, No. 37, pp. 65–69.

*Primary Examiner*—Mark Rosenbaum

*Attorney, Agent, or Firm*—Dirk J. Veneman; Raymond W. Campbell

[57] ABSTRACT

An apparatus for improving the pulping characteristics of wood chips in which a pair of closely operating rolls are provided for supplying compressive force to chips passed therebetween, at least one roll having an aggressively contoured surface for causing chips to crack in the thickness dimension of the chip as compressive force is applied to the chip.

20 Claims, 1 Drawing Sheet

II
II
10
12
14
16
18
20
22
24
26
28
30
32
40
42
44
46
50
52
54
56
72
74

12
20
22
26
32
42
52
60
62
64
66
70
72
74
76
78
80

100
102
104
106
108

106
108

106
108

106
108

WOOD CHIP CRACKING APPARATUS

FIELD OF THE INVENTION

The present invention relates to an apparatus for treating wood chips, to enhance liquor penetration and subsequent pulping operations, and relates more particularly to destructuring apparatus in which chips are passed between closely operating rolls with compressive forces being exerted on the chips by the rolls.

BACKGROUND OF THE INVENTION

In a typical paper making process, logs are debarked and chipped, and individual cellulose fibers are then freed or liberated from the chip for subsequent treatment and ultimate paper web formation. A common way to liberate the cellulose fibers is by cooking the wood chips with chemicals at elevated temperatures and pressures in digesters to remove lignen from the chips, which holds the fibers together. For the subsequent paper making process, it is desirable that the delignified fibers obtained exhibit substantially similar characteristics. To minimize the production of undercooked or overcooked chips in the digester, it is necessary that the cooking liquor penetration into the chips is substantially similar for all chips, so that the effects of temperature, pressure, and time are similar for all chips. Therefore, it has been found desirable in the past to utilize chip screening apparatus which removes both undersized and oversized chips, so that the undersized can be treated separately and the oversized passed through chip size reducing apparatus prior to digesting.

A commonly used apparatus for reducing the size of oversized chips separated from a chip stream by screens is a chip slicer. The basic operation of a chip slicer includes a rotor operating within a drum, wherein the oversized chips are forced against knives and are thereby sliced to acceptable thickness. An example of a chip slicer can be found in U.S. Pat. No. 4,235,382 issued to William C. Smith for a "Method and Apparatus for Rechipping Wood Chips". While chip slicers such as that taught in U.S. Pat. No. 4,235,382 work effectively to reduce the size of oversized chips, thereby substantially reducing the occurrence of undercooked chips in a digesting process, chip slicers which are not working within optimum design parameters, such as when knives are dull, or improper speed or loading occurs, tend to generate fines while reducing oversized chips. Thus, while minimizing the problem associated with oversized chips, chip slicers tend to increase the problem of undersized chips or fines. Therefore, it is desirable to develop an apparatus for treating oversized wood chips which does not compound the problems associated with fines or undersized chips.

Closely operating rolls have been utilized in the past for treating oversized chips by compression, and thereby affecting liquor penetration into the chips. For example, U.S. Pat. No. 4,050,980 issued Sept. 27, 1977 to Fred L. Schmidt and Frank J. Steffes for "Selective Delamination of Wood Chips". This patent teaches screening a chip stream and passing the oversized chips through closely operating rolls for selective delamination by compression.

U.S Pat. 3,393,634 issued July 23, 1968 to John M. Blackford for a "Method and Apparatus for Loosening Fibers of Wood Chips". This patent teaches closely operating rolls with an apparatus for directing chips edgewise into the crotch between the rolls, with the rolls compressing the chips transversely of their thickness to at least about one-fifth of their original thickness, but not more than about one-tenth of their original thickness. Thereafter, the chips are allowed to expand to their original shape, with the fibers therein having been loosened and the porosity of the chips having been increased.

In each of the two above-mentioned patents, the opposed, closely operating rolls, or delamination rolls compress the chips for loosening the fibers therein. The rolls are smooth, so that the only action on the chips is compressive, whereby the chip structure is not substantially changed other than for a loosening of the fibers.

A problem associated with the use of delamination rolls is that throughput is low. Chips tend to stay in the pocket above the rolls, and, particularly the larger chips which are most in need of delamination, tend to ride between the rolls in the upper portion of the roll couple, without being drawn through the rolls.

A typical structure for a chip destructuring apparatus is disclosed in an article entitled "A Machine For Destructuring Wood Chips by Rolling" by John A. Oldham in the July 1983 issue of APPITA, Volume 37, Number 1. In the last paragraph of the first column on Page 65, the destructuring machine is described as having "smooth, chrome surfaced, very rigid rollers". The aforedescribed problem of passing larger chips through the nip is discussed in the first paragraph on Page 66. The larger chips "often would not enter between the smooth rollers; the surface of the rollers slipped over the chips". It is then described that the chips remaining above the rolls obstructed feeding of succeeding chips causing clotting or bridging. In the third paragraph on Page 66, a solution is discussed wherein small grooves, only one millimeter deep were cut parallel to the roll axis at approximately 10 millimeter spacings. Harsher roll surfaces are not deemed appropriate, since an unacceptable amount of fiber damage would be created. General roughening of the roll surface is also described as being likely to improve feed reliability.

An analysis of the effects of chip destructuring or delamination was presented at the 1984 TAPPI Pulping Conference by D. Lachenal, P. Monzie, and C. de-Choudens in a paper entitled "Chip Destructuring Improves Kraft Pulping", TAPPI November 1984, Book 1, Pages 13–17. In the apparatus used for the pulping trials discussed in the article, again the rollers were smooth, and the chips were compressed.

Destructuring or delamination as known previously has not been accepted as a standard process in pulping operations, largely, it is believed, due to the low capacities of delamination devices and inconsistent results and subsequent effects on digesting operations.

It is therefore one of the principal objects of the present invention to provide an apparatus for treating oversized chips in a manner to reduce the necessary cooking time therefore, to achieve in the treated oversize chips delignification levels similar to that for smaller chips during identical delignification processes, with resultant pulps having similar characteristics and properties.

It is another object of the present invention to provide an apparatus for treating oversized chips quickly and efficiently with rapid throughput, while minimizing plugging or blinding of the apparatus.

It is yet another object of the present invention to provide a wood chip treating apparatus which cracks or fractures oversized chips without generating additional fines or pin chips, and which is simple in operation, requiring minimal adjustment for optimal operation.

A still further object of the present invention is to provide an apparatus for treating wood chips to increase the rate of liquor impregnation particularly of large chips and for providing an apparatus to destructure wood chips which is not dependent on a particular chip orientation between the closely operating rolls.

SUMMARY OF THE INVENTION

These and other objects are achieved in the present invention by providing closely operating, oppositely rotating rolls having highly aggressive surfaces. In a preferred design, the rolls have matrices of pyramid shaped projections machined into their surfaces. In a preferred embodiment, the peaks of the pyramids are spaced one-half inch apart, and the depth of the machining from the peak to the base of an individual pyramid is approximately one-quarter inch. In operation, the peaks of the rolls may be placed in peak-to-peak orientation or in peak-to-valley orientation. In use, the chips are fractured along the direction of fiber orientation, and with the present apparatus, the chips will crack there along regardless of how the chip enters the nip between the rolls.

The present invention differs from conventional thinking for destructuring or delamination devices, in that a highly aggressive surface is used, not merely to compress the chips, but to actually break or fracture the chip, generally through the thickness dimension of the chip previously such chip cracking has been believed undesirable.

Additional objects and advantages of the present invention will become apparent from the following detailed description and the accompanying drawing.

DETAILED DESCRIPTION OF THE PREFERRED EMBODIMENT

Figure 1:
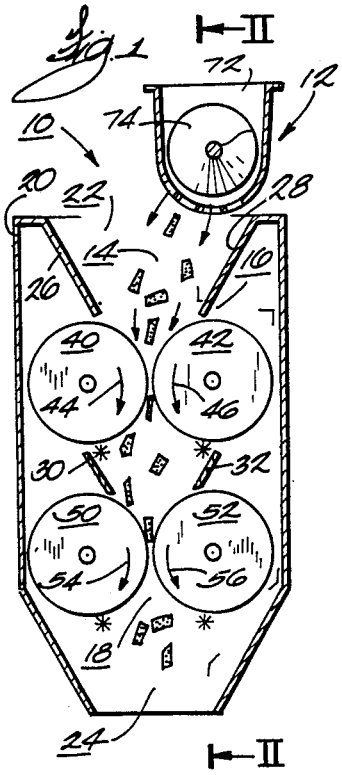
FIG. 1 is a cross-sectional, end view of a wood chip cracking apparatus embodying the present invention.

Referring now more specifically to the drawing, and to FIG. 1 in particular, numeral 10 designates a wood chip cracking apparatus embodying the present invention. The apparatus 10 receives wood chips from a distributing device 12 which supplies an even flow of wood chips generally indicated by numeral 14 to top and bottom roll couples 16 and 18. The roll couples 16 and 18 are disposed in a housing 20 having a top opening 22 through which the wood chips 14 enter, and a bottom opening 24 through which the treated wood chips flow from the apparatus. The incoming flow of chips 14 is directed by baffles 26 and 28 to the upper roll couple 16, and the chips passing through the upper roll couple are directed by baffles 30 and 32 to the bottom roll couple 18. A suitable conveying apparatus, not shown, carries the treated chips from the apparatus 10 to subsequent process steps.

Top roll couple 16 includes rolls 40 and 42 closely spaced and oppositely driven, so that in the upper pocket between the rolls, the surfaces are running toward a narrow region formed by the closely spaced rolls 40 and 42, as indicated by the arrows 44 and 46.

The bottom roll couple 18 includes rolls 50 and 52 closely spaced and oppositely driven, so that in the upper pocket between the rolls, the surfaces are running toward a narrow region formed by the closely spaced rolls 50 and 52, as indicated by the arrows 54 and 56.

Each of the rolls 40, 42, 50, and 52 is suitably journalled in bearings generally indicated at numeral 60 in housing 20, and a drive mechanism 62 is provided for turning the rolls. The drive mechanism 62 may include a motor 64, or other source of power, and a drive train 66. The drive train 66 may drive each of the rolls; however, it has been found that in some applications of the present invention, it is necessary to drive only one roll of each roll couple. The mating roll in each roll couple opposite the driven roll can merely idle, and, in this manner, the energy requirements for operating the machine are reduced, in that when chips are not flowing to the apparatus, only one roll of each couple is being driven. As chips enter the apparatus and wedge between the driven and non-driven rolls, the non-driven roll will rotate, aiding in the cracking operation and in the passing through of wood chips.

The distributing device 12 includes a housing 70 having an opening 72 for receiving chips from a chip supply apparatus not shown, a distributing screw 74 for evening the flow of chips along the distributing device, and a distributing grid 76 through which chips pass from the distributing device 12 to the first roll couple 16. The distributing screw 74 is driven at 78 by a suitable source of power and is journalled in bearings 80 in the housing 70.

Figure 2:
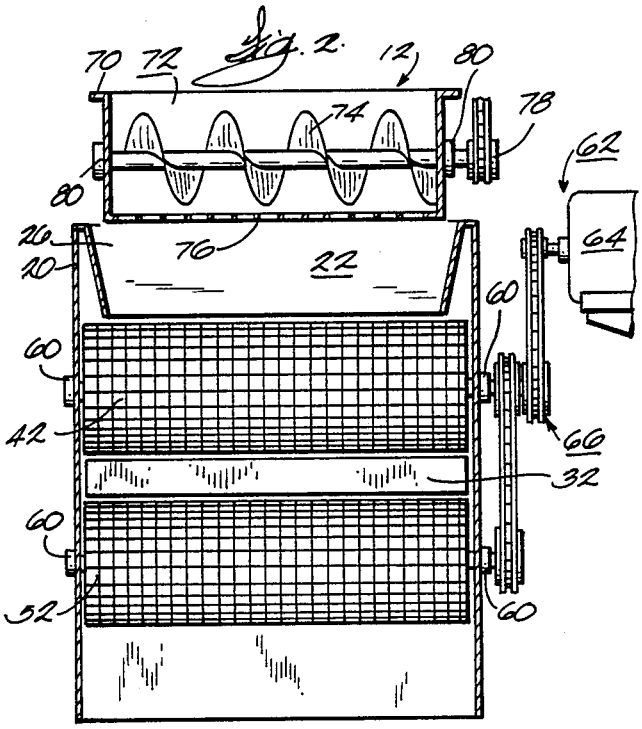
FIG. 2 is a vertical cross-sectional view of the wood chip cracking apparatus shown in FIG. 1, taken generally along line II—II of FIG. 1.

It should be understood by those skilled in the art that the arrangement shown in FIGS. 1 and 2 for the wood chip cracking apparatus of the present invention is merely one example of a suitable arrangement. In some installations, it may be desirable to use only one roll couple or to use more than two roll couples, and the apparatus for supplying chips to the roll couple or couples may be of types other than the distributing device 12 described above.

Figure 3:
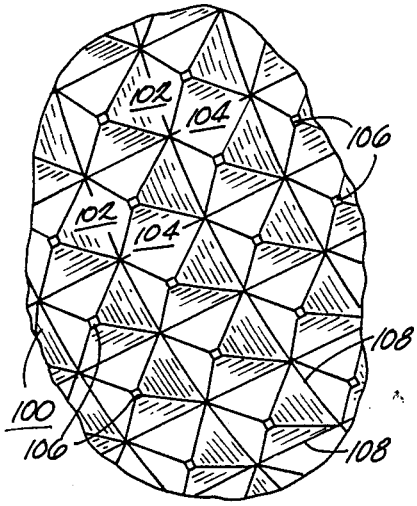
FIG. 3 is a perspective view of a portion of the roll surface for one of the rolls of a wood chip cracking apparatus embodying the present invention.

The surfaces of the rolls used in the present invention differ from that of rolls used for delaminating chips previously, in that the roll surfaces of the present invention are aggressively contoured. In the embodiment shown in FIG. 3, the roll surface comprises a matrix of pyramid shaped projections 100 which are formed by machining into the roll surface circumferential v-shaped valleys 102 and axial v-shaped valleys 104 in the roll at right angles. By machining such intersecting valleys, four-sided pyramids are formed extending radially outward on the roll surface. Each of the projections 100 has a peak 106 formed by the remaining material from the outer portions of the machined roll surface, and a base 108 defined by the depth of the intersecting valleys 102 and 104 in the machined material zone. Normally both rolls of the roll couples have similar surface configuration; however, it may be desirable to have one roll of each roll couple be smooth or otherwise have a more aggressively or less aggressively contoured surface than that of the other roll in the roll couple.

In one structure found to work advantageously, the roll surface was formed wherein the peaks 106 were spaced one-half inch apart, and each peak comprised a flattened surface approximately one-sixteenth inch square. The depth of each pyramid, from peak 106 to base 108 was six millimeters.

In the use and operation of an apparatus for destructuring wood chips as depicted in the aforedescribed drawings, chips are supplied to the distributing device 12, and from the distributing device 12 are supplied evenly along the axial extent of the first roll couple 16. The chips entering the distributing device 12 can be from a previous screening step, and comprise only the oversize chips separated at a previous screening step, or the entire chip flow to a pulping operation can be processed through the apparatus of the present invention. In yet other applications, it may be desirable to separate from the total chip stream only the under size chips, and then process both oversize and acceptable size chips through the present apparatus.

One significant advantage of the present invention is that the highly aggressive surface on the rolls significantly minimizes, virtually eliminating the heretofore recognized problem of chips not being pulled between the rolls, but instead, particularly with overlarge chips, riding above the rolls, with rolls sliding there along. Thus, a high volume of chips can be passed through the present apparatus, making it possible to process the entire chip flow in the pulp mill, potentially even eliminating the need for screening out oversized chips. If acceptable and oversized chips all can be passed through the apparatus, it is unnecessary to separate the overlarge for separate treatment. The small and acceptable chips, through proper roll spacing, will pass through the device substantially untreated, while only the oversize will be cracked. However, after treatment, the acceptable and treated oversize chips will respond similarly to pulping.

Figure 4:
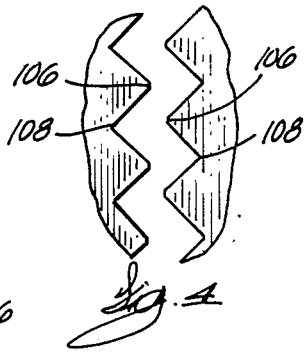
FIG. 4 is a fragmentary end view of one of the roll couples in a wood chip cracking apparatus embodying the present invention, showing one manner of adjacent roll orientation.
Figure 5:
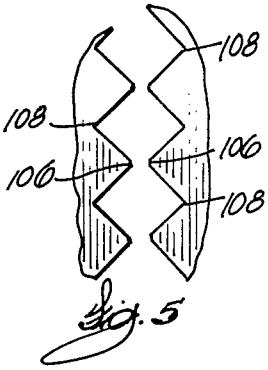
FIG. 5 is a fragmentary end view similar to that of FIG. 4, but showing another manner of roll orientation.
Figure 6:
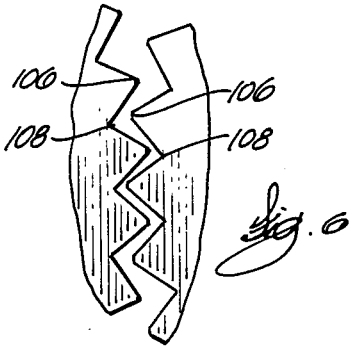
FIG. 6 is yet another fragmentary end view similar to that of FIGS. 4 and 5, but showing yet another manner of roll orientation.

From the distributing device 12, the chips enter the region above the roll couple. The rolls may be separately driven, and positions controlled such that they are aligned in a peak to valley orientation such as shown in FIG. 4. Alternatively, in some processes and for some types of wood chips, it is desirable to control the roll's orientation in a peak-to-peak orientation as shown in FIG. 5. In yet other processes wherein a substantial compression in addition to cracking is desired, or wherein the acceptable chip thickness is quite thin, a closely intermeshed peak-to-valley relationship, as shown in FIG. 6, may be desirable. In yet other operations, particularly when the power input to the apparatus is to be minimized as much as possible, only one roll of each roll couple is driven, and the other merely idles. As chips approach the rolls and are pinched therebetween, the idle roll is driven by the driven roll through the driving connection formed by the wood chips compressed therebetween.

As chips are passed between the roll couples, regardless of the chip orientation, the chips tend to crack or split parallel to the fiber orientation in the chip. This is true whether the chip passes between the rolls lengthwise or endwise.

When the peak-to-valley orientation, as shown in FIGS. 4 or 6, is used, together with pyramid-shaped projections spaced one-half inch from each other, and being approximately six millimeters high, the cracks created in the chips occur approximately every one-fourth inch. This spacing of the cracks formed generally corresponds to the typically acceptable chip thickness in pulping operations. By cracking the chips, openings are created in the larger surfaces of the chips to aid liquor penetration. In addition to any fiber loosening which may result from compression, liquor penetration into the chip is aided by the actual physical openings created by the cracks. Displacement of the material near the crack is generally greater for thicker chips than for thinner chips, and thus, the opening for liquor penetration is less obstructed for thicker chips than thinner chips, thereby equalizing liquor penetration rates in the thicker and thinner chips. Because the rolls are spaced apart, the core of the chip is not displaced, and even with very thick chips, although surface displacement near the cracks may be significant and the general shape of the chip may be slightly changed, the integrity of the chip is not compromised, and the chip remains whole without the generation of pins, fines, or broken chips.

When a plurality of vertically arranged roll couples are used, as shown in FIGS. 1 and 2, it may be advantageous to provide progressively decreasing roll spacing on the lower roll couples. In this way, the largely oversized will be compressed and/or fractured by the upper rolls, with the acceptable and minimally oversized passing therethrough. Subsequent roll couples will further process the greatly oversized and process the minimally oversized.

Laboratory pulping studies have been conducted on chips processed through a single roll couple of the present invention wherein the projections of the adjacent rolls were intermeshed, as shown in FIG. 6. As a control, one sample was not treated, and other samples were sliced by conventional chip thickness slicing techniques.

Several different samples were treated in a wood chip cracking apparatus of the present invention. Several samples were treated in what is termed a "mild treatment" and others were treated in a "harsh treatment". In the mild treatment, the spacing between the projections in the region where projections from each roll are at their closest was six millimeters. In the harsh treatment, the spacing at the closest point of spacing between projections on separate rolls was three millimeters. Table 1 hereinafter summarizes the characteristics of the various samples on which pulping studies were conducted.

TABLE 1

| (Sample Characteristics) | | |
|---|---|---|
| Sample | Species | Treatment |
| 1 | Pine | Not Treated |
| 2 | Pine | Mild |
| 3 | Pine | Harsh |
| 4 | Pine | Sliced |
| 5 | Pine/Fir | Sliced |
| 6 | Pine/Fir | Harsh |

The samples were fractionated in a Rader Companies CC2000 Chip Classifier. Samples were divided into fines, which would pass through a 3 millimeter round hole; pins which were between 0 and 2 millimeters thick; accepts, which were between 2 and 8 millimeters thick; total over thick greater than 8 millimeter; and highly over thick greater than 14 millimeter. Table 2 summarizes the thickness characteristics of each sample.

TABLE 2

| Sample | (Thickness Classification in Percentage) 14 mm | 8 mm | 2–8 mm | 0–2 mm | Fines |
|---|---|---|---|---|---|
| 1 | 46.2 | 82.4 | 17.5 | 0 | 0 |
| 2 | 16.0 | 50.0 | 33.0 | 0.7 | 0.3 |
| 3 | 8.8 | 53.6 | 44.8 | 0.8 | 0.8 |
| 4 | 0 | 4.5 | 91.5 | 3.1 | 0.9 |
| 5 | 0.4 | 7.1 | 84.8 | 5.4 | 2.7 |
| 6 | 29.2 | 84.8 | 15.2 | 0 | 0 |

In all of the samples except those in which the overthick chips were sliced, fifty percent or more of the chips in each sample were greater than the maximum established acceptable thickness of 8 millimeters. Several samples included high percentages of overly thick chips greater than 14 millimeters.

The samples were cooked in a laboratory batch digester using kraft digesting processes. Several samples were cooked in separate batches under two separate cooking conditions. One batch was cooked using a 15%/85% blend of chips from samples 3 and 4. The pulping conditions used for each batch and the chip sample type are described below in Table 3.

TABLE 3

| Sample | (Pulping Conditions) Max Pressure Min./P.S.I. | Eff Alkali %/Resid. Wood/(g/e) | % Yield Total/Rej./ Screened | Kappa Number |
|---|---|---|---|---|
| 1 | 50/105 | 15.8/14.3 | 52.5/16.5/36.0 | 48.4 |
| 2 | 50/105 | 15.8/14.3 | 46.3/0.8/45.5 | 44.7 |
| 2 | 70/112 | 16.1/13.8 | 44.1/0.4/43.7 | 30.1 |
| 4 | 70/112 | 16.1/13.6 | 44.9/0.9/44.0 | 32.8 |
| 3 | 50/112 | 16.2/13.9 | 45.3/0.5/44.8 | 40.6 |
| 3 | 60/105 | 15.8/13.7 | 47.0/0.7/46.3 | 44.6 |
| 4 | 60/105 | 15.8/13.7 | 49.2/2.7/46.9 | 48.3 |
| 3/4 | 50/112 | 16.4/14.3 | 45.8/1.6/44.2 | 38.0 |
| 5 | 50/112 | 15.9/12.6 | 46.3/4.5/41.8 | 46.8 |
| 6 | 50/112 | 15.9/12.6 | 49.2/5.0/44.2 | 45.2 |

Pulp strength properties were calculated after refining the cooked pulps at 3000 revolutions, Table 4 shows these results.

TABLE 4

| Sample | (Unbleached Strength Properties) Freeness (CSF) | Porosity | Break Length (Km) | % Stretch | Tear | Mullen |
|---|---|---|---|---|---|---|
| 1 | 600 | 606 | 7.7 | 3.7 | 246 | 138 |
| 2 | 600 | 655 | 7.7 | 3.9 | 195 | 120 |
| 2 | 534 | 312 | 7.9 | 3.8 | 200 | 121 |
| 4 | 543 | 262 | 7.9 | 3.8 | 230 | 134 |
| 3 | 540 | 264 | 7.8 | 3.5 | 187 | 121 |
| 3 | 540 | 264 | 7.8 | 3.5 | 187 | 120 |
| 4 | 570 | 307 | 7.6 | 3.1 | 217 | 135 |
| 3/4 | 572 | 336 | 7.9 | 3.8 | 238 | 134 |
| 5 | 543 | 141 | 9.8 | 3.8 | 189 | 161 |
| 6 | 581 | 192 | 9.1 | 3.8 | 172 | 148 |

As seen in Table 4, the break length and stretch were substantially unaffected by the current chip cracking process of the present invention. Both sliced and cracked chips yielded similar strength characteristics. Tear, strength, and mullen, were, however, lower for the cracked chips. The decreased tear was realized at the entire freeness range examined, with the lowest tear from the harshly treated chips. However, when mixed with sliced chips, the resultant tear from pulps combining samples 3 and 4 was higher than that for the sliced chips (sample 4). Hence, mixtures of cracked chips with regular chips for pulping should be acceptable.

In terms of yield, pulps from chips treated by an apparatus according to the present invention contained minimal reject levels and substantially less rejects than pulp from the sliced chips. The overall yield out of the digester was, however, somewhat lower for the chips processed according to the present invention; however, this is believed to be less significant when the percent yield of acceptable fibers is compared.

It can be seen that the present invention provides a means for treating oversize chips which yields acceptable, usable pulp having characteristics similar to pulps obtained from acceptable size chips. At the same time, the apparatus of the present invention substantially reduces fines generation and reject fibers when compared to chips processed by conventional slicing techniques or pulps obtained from untreated chips. The simplicity of operation of the present invention makes it advantageous over chip slicers which require more frequent adjustment for proper operation.

While an apparatus for destructuring wood chips has been shown and described in detail herein, various changes may be made without departing from the scope of the present invention.

I claim:

1. An apparatus for destructuring wood chips comprising;

first and second rolls disposed for rotational operation substantially parallel to each other, and spaced from each other a preselected distance for applying compressive force to wood chips passing therebetween, means for supplying a flow of wood chips to said first and second rolls and for distributing the wood chips along the axial extent of said first and second rolls, at least one of said first and second rolls being connected to means for rotating said at least one roll about its longitudinal axis, at least one of said rolls having an aggressively contoured roll surface including a matrix of outwardly extending discrete projections, said projections being of a height substantially equivalent to the desired chip thickness, causing said chips to be cracked primarily in a direction parallel to the chip fibers as compressive force is applied thereto when the chips pass between said first and second rolls.

2. An apparatus for destructuring wood chips as defined in claim 1, in which one of said first and second rolls is connected to a means for rotating said roll about its longitudinal axis and the other of said rolls is journalled in bearings and freely rotating therein.

3. An apparatus for destructuring wood chips as defined in claim 1, in which both of said first and second rolls are similarly aggressively contoured for causing chips to be cracked as compressive force is applied thereto when the chips pass between said first and second rolls.

4. An apparatus for destructuring wood chips as defined in claim 3, in which said aggressively contoured surfaces of said first and second rolls consist of a matrix of pyramid-shaped projections on the roll surface.

5. An apparatus for destructuring wood chips as defined in claim 4, in which said pyramids are immediately adjacent to each other.

6. An apparatus for destructuring wood chips as defined in claim 4, in which the rotation of each of said first and second rolls about the respective longitudinal axis of each is controlled, and the rolls are aligned such that the pyramids are substantially aligned in peak-to-peak relationship in the region wherein said first roll is closest to said second roll.

7. An apparatus for destructuring wood chips as defined in claim 4, in which the rotation of each of said first and second rolls about the respective longitudinal axis of each is controlled and the rolls are aligned such that the pyramids are substantially aligned in peak-to-valley relationship in the region wherein said first roll is closest to said second roll.

8. An apparatus for destructuring wood chips as defined in claim 4, in which said rolls are disposed sufficiently close to each other such that the pyramid-shaped projections of one roll internest with the pyramid-shaped projections of the other roll.

9. An apparatus for destructuring wood chips as defined in claim 4, in which said pyramid-shaped projections are at least about five millimeters high, measured from the peak of a projection to the base of a projection.

10. An apparatus for destructing wood chips as defined in claim 1, in which said aggressively contoured roll includes a matrix of pyramid-shaped projections extending substantially radially outward from the surface of said roll.

11. In an apparatus for loosening fibers in wood chips by passing at least the oversized chips between closely operating rolls for applying compressive force to the chips, the improvement comprising:

at least one of said rolls having a highly aggressively contoured roll surface including a matrix of substantially radially extending discrete projections for cracking the chips passing between said rolls, said projections being spaced from each other to create said cracks in said chips, said cracks being spaced from each other a distance substantially equivalent to the desired chip thickness, said cracks being discrete openings in the chip surface formed in a thickness dimension of the chip, generally parallel to the fiber orientation.

12. In the improved apparatus for loosening fibers in wood chips as defined in claim 11, the further improvement in which one of said rolls is connected to means for rotating said one roll about its longitudinal axis and the other of said rolls is suitably journalled in bearings for free rotation.

13. The improved apparatus for loosening fibers in wood chips as defined in claim 11, in which both of said rolls are highly aggressively contoured with discrete, radial projections for cracking the chips in the thickness dimension of the chip.

14. The improved apparatus for loosening fibers in wood chips as defined in claim 13, in which each of said rolls is connected to means for rotating said rolls about the longitudinal axis thereof.

15. The improved apparatus for loosening fibers in wood chips as defined in claim 14, in which said highly aggressively contoured surfaces of said rolls include pyramid-shaped projections extending substantially radially outward from said rolls.

16. In the improved apparatus for loosening fibers in wood chips as defined in claim 15, the further improvement in which said pyramids are spaced approximately one-half inch from each other on a roll, and said pyramids are at least about five millimeters high from the peak of a pyramid to a base of the pyramid.

17. In the improved apparatus for loosening fibers in wood chips as defined in claim 15, the further improvement in which, at the region of closest spacing between the rolls, the peaks of the pyramid-shaped projections of one roll are substantially in alignment with the peaks of the pyramid-shaped projections of the other roll.

18. In the improved apparatus for loosening fibers in wood chips as defined in claim 15, the further improvement in which, in the region of closest spacing between the rolls, the pyramid-shaped projections of one roll are substantially aligned intermediate the pyramid-shaped projections of the other roll.

19. In the improved apparatus for loosening fibers in wood chips as defined in claim 18, the further improvement in which said rolls are closely spaced and said pyramid projections of one of said rolls internest with the pyramid-shaped projections of the other of said rolls.

20. In the improved apparatus for loosening fibers in wood chips as defined in claim 11, the further improvement in which the highly aggressively contoured surface of said at least one of said rolls includes pyramid-shaped projections formed by cutting circumferential and longitudinal valleys in a substantially smooth surfaced roll, the pyramids being roll material remaining after said valleys are cut, and each of said pyramids being spaced from adjacent pyramids approximately one-half inch and each of said pyramids being approximately five millimeters in height from the top of a pyramid to the base of the pyramid substantially at the bottom of a valley.

* * * * *

UNITED STATES PATENT AND TRADEMARK OFFICE
Certificate

Patented: Sept. 4, 1990

Patent No. 4,953,795

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Joseph Bielagus and James R. Montgomery Signed and Sealed this Twentieth Day of November 1990.

HOWARD N. GOLDBERG

*Supervisory Patent Examiner*
*Art Unit 326*